US010259103B2

(12) United States Patent
Engibarov

(10) Patent No.: US 10,259,103 B2
(45) Date of Patent: Apr. 16, 2019

(54) HIGH THROUGHPUT MACHINING PALETTE SYSTEM

(71) Applicant: Eddy Engibarov, Las Vegas, NV (US)

(72) Inventor: Eddy Engibarov, Las Vegas, NV (US)

( * ) Notice: Subject to any disclaimer, the term of this patent is extended or adjusted under 35 U.S.C. 154(b) by 0 days.

(21) Appl. No.: 14/678,790

(22) Filed: Apr. 3, 2015

(65) Prior Publication Data

US 2016/0288284 A1 Oct. 6, 2016

(51) Int. Cl.

*B25B 1/00* (2006.01)
*B25B 1/02* (2006.01)
*B25B 1/24* (2006.01)

(52) U.S. Cl.

CPC ..... *B25B 1/00* (2013.01); *B25B 1/02* (2013.01); *B25B 1/2489* (2013.01)

(58) Field of Classification Search

CPC ..... B25B 1/2489; B25B 5/16; B25B 5/163; B25B 5/006; B25B 5/166

See application file for complete search history.

(56) References Cited

U.S. PATENT DOCUMENTS 2,625,861 A 1/1953 Swanson
4,445,678 A * 5/1984 George ..... B23Q 3/104 269/282
4,643,411 A * 2/1987 Izumi ..... B25B 5/08 269/138
4,802,661 A 2/1989 Jewett, Sr.
5,056,766 A * 10/1991 Engibarov ..... B25B 1/08 269/101
5,060,920 A 10/1991 Engibarov
5,139,246 A 8/1992 Yakou
5,226,637 A * 7/1993 Kitaura ..... B25B 5/08 269/234
5,324,013 A * 6/1994 Marino ..... B25B 1/08 269/137
5,330,167 A 7/1994 Plumb
5,906,365 A 5/1999 Wu
5,984,291 A 11/1999 Iwata
6,126,158 A * 10/2000 Engibarov ..... B25B 5/08 269/101
2003/0233925 A1* 12/2003 Makropoulos ..... B23D 47/02 83/829
2014/0341665 A1* 11/2014 Clark ..... B23Q 11/0042 408/67

* cited by examiner

*Primary Examiner* — Tyrone V Hall, Jr.
(74) *Attorney, Agent, or Firm* — Workman Nydegger

(57) ABSTRACT

A palette for an automated machining system includes a body, a plurality of fasteners configured to apply a force laterally to body to fasten the body to a receiver in the automated machining system, and a soft jaw mechanism connected to the body. The soft jaw includes one or more locking blocks that are anchors for a floating block and wedge block that apply a force to hold a workpiece at a reproducible location between the one or more locking blocks. The floating block is configured to not engage with the body, workpiece, or wedge block beyond friction and/or compressive forces.

8 Claims, 6 Drawing Sheets

HIGH THROUGHPUT MACHINING PALETTE SYSTEM

BACKGROUND OF THE DISCLOSURE

Workpieces are typically held in place on a machining table with a vise having a fixed or "hard" jaw and a movable or "soft" jaw. A jaw is typically a device configured to hold a workpiece in place by applying a compressive force to the workpiece. The compressive force is generated by the linear motion of a soft jaw of the vise that is urged forward by the rotational movement of a screw drive or other force conversion mechanism to convert a torque to a linear motion. The screw drive provides a mechanical advantage to magnify force applied to the workpiece. However, as a compressive force is applied to the workpiece, the compressive force between the soft jaw and the screw drive may increase the friction therebetween, resulting in a rotational movement of the soft jaw and/or workpiece. A soft jaw may, therefore introduce variations in the placement of a workpiece when work on a first workpiece is complete and the first workpiece is removed and replaced with a second workpiece.

An example of a soft jaw for a machining vise is disclosed in U.S. Pat. No. 6,126,158, the disclosure of which is incorporated herein by reference in its entirety. A soft jaw may allow for the application of a compressive force to a workpiece with little to no transmission of a torque or other vertical movement to the workpiece. For example, a soft jaw may use an angled face between a jaw block and a drive block to apply a compressive force to the workpiece that is substantially linear and normal to the interface between the workpiece and the jaw block. The soft jaw applies a compressive force to the workpiece without altering the position of the workpiece (e.g., rotating or lifting the workpiece in the vise) to facilitate precision machining.

An automated machining or milling system, such as a computer numerical control ("CNC") cutting machine, allows a machinist to load a template into the automated machining system and produce a part. The automated machining system can then use the same template to produce a plurality of identical parts. However, the accuracy of the automated machining system (i.e., the accuracy of the placement of the cuts in a workpiece) is at least partially dependent upon the precise position of the workpiece in the automated machining system. For example, when cutting a workpiece by hand, a machinist or woodworker will use the workpiece itself as the frame of reference for the cuts made in the workpiece. The reference frame for the movements of the automated machining system, in contrast is the chamber and/or table of the automated machining system. The position of the workpiece within the automated machining system is provided to the automated machining system by calibrating the automated machining system for each new workpiece that is placed in the automated machining system.

Calibrating the automated machining system between the cutting of each workpiece is a time-consuming process. The automated machine must of necessity be recalibrated each time an operator places additional workpieces in the machine to produce more pieces according to a previous template. Downtime of the automated machining system is financially costly as any downtime precludes time that commercially valuable pieces may be produced. A workpiece holder that allows for the minimization of calibration time is therefore desirable.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In an embodiment, a palette has a body with a top surface. The top surface has a slot. A locking block engages with a locking block backing member located in the slot. The palette also includes a wedge block connected to a wedge backing member with a wedge adjustable fastener. The wedge block has an angled surface such that movement of the wedge block perpendicular to the top surface applies a lateral force to a floating block.

In some embodiments, the body further includes a plurality of mechanical interlocking features. The locking block has one or more complimentary mechanical interlocking features that limit the movement of the locking block relative to the top surface. The floating block may have a flat surface that does not engage with the plurality of mechanical interlocking features.

In another embodiment, the mechanical interlocking features are grooves that are substantially perpendicular to the slot and the locking block has a complimentary plurality of grooves.

In yet another embodiment, the body has a plurality of pockets in the sides thereof and the pockets have a beveled portion. The palette is attached to a receiver using a plurality of fasteners that have a complimentarily angled head on the fastener to engage with the beveled portion of the pockets.

In a further embodiment, the locking block includes a channel with a positioning pin located therein. The channel and the positioning pin each have a flared end and a tapered end. The flared end of the positioning pin has a greater diameter than the tapered end of the channel, and the movement of the positioning pin toward the tapered end of the channel is inhibited by the channel, while the positioning pin moves freely toward and out of the flared end.

In a yet further embodiment, the body and a receiver engage via an engagement interface to align the body and receiver during positioning of the body on the receiver.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
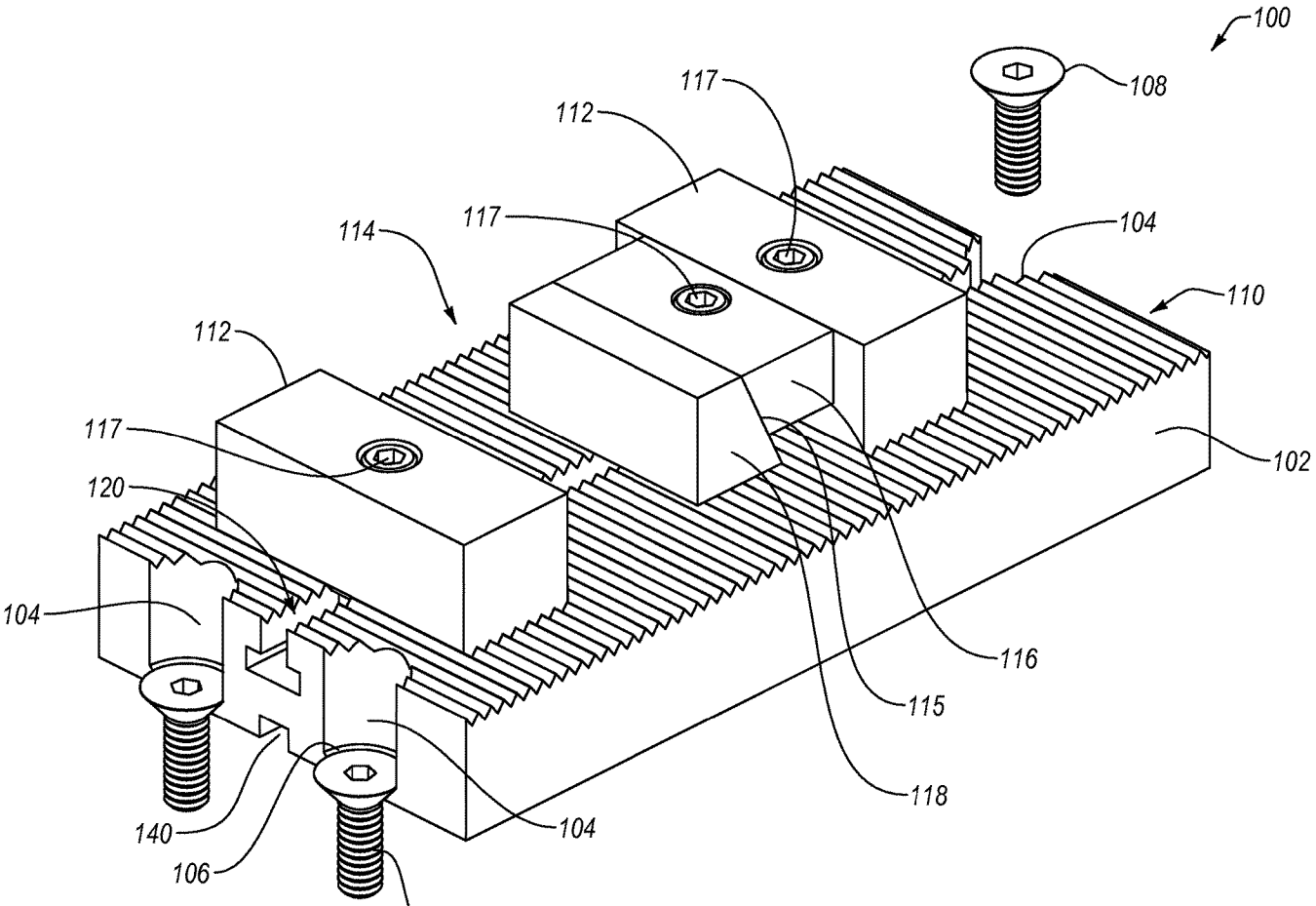
FIG. 1 is a perspective view of an embodiment of a high throughput palette system according to the present disclosure.

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to constructing and installing a high throughput machining palette. The palette may include an alignment member to align the position of the palette with a receiver, table, or other holder in an automated machining system. While the present disclosure may refer to the part of the automated machining system to which the palette may attach as the receiver, other attachment methods are contemplated. The palette may include one or more slots in a surface of the palette that form an angle with a plurality of grooves in the surface of the palette. The slots may allow selective securement of one or more locking blocks along the slots relative to the palette. The plurality of grooves may allow the one or more locking blocks to be selectively secured at known increments. For example, the plurality of grooves may be perpendicular to a slot. The plurality of grooves may have a repeating distance between each of the grooves, providing a grid in which the one or more locking blocks may be positioned. The plurality of grooves may provide a mechanical interlock between the one or more locking blocks and the palette to limit or substantially prevent movement of the one or more locking blocks relative to the grooves. The slot may provide a mechanical interlock between the one or more locking blocks and the palette to limit or substantially prevent movement of the one or more locking blocks relative to the slot.

The locking blocks may, therefore, be repeatedly and reliably positioned on the grid at known and/or identifiable positions relative to the receiver. The locking blocks may provide fixed anchors against which a soft jaw may press when providing a substantially linear compressive force to hold a workpiece in a desired position. The locking blocks may provide a precise and accurate space in which the soft jaw may be positioned. A locking block and/or a soft jaw may include a positioning pin that may be extended from a surface of the locking block and/or soft jaw to position the workpiece in a precise and reproducible position relative to the locking block and/or soft jaw. Recalibration of the automated machining system may be avoided, and hence downtime may be minimized, by providing an interchangeable palette in the automated machining system that retains each workpiece in a precise and accurate position that is repeatable.

FIG. 1 depicts an embodiment of a palette system 100 according to the present disclosure. The palette system 100 includes a palette body 102 having a plurality of pockets 104 in the sides of the palette body 102. The pockets 104 may have beveled portions 106 in at least part of the pocket 104. In some embodiments, the bottom of the pocket 104 includes the beveled portion 106. In other embodiments, the entire pocket 104 may be the beveled portion. In yet another embodiment, there is no pocket 104. Some or all of a back edge of the palette body 102 is the beveled portion 106. At least part of the pocket 104 may engage with a fastener 108 that may affix the palette body 102 to a receiver in an automated machining system. The fasteners 108 may be a bolt, a screw, a rivet, a nut, other mechanical fastening device, or combinations thereof. For example, a fastener 108 may be a bolt having an angled head, the angled head engaging the beveled portion 106 of the pocket 104.

The interaction of the beveled portions 106 of the plurality of pockets 104 with the plurality of fasteners 108 may provide both a compressive force directed downward (relative to the body 102) toward a receiver as well as a plurality of lateral forces toward the body 102. The plurality of lateral forces may act against the plurality of pockets 104 in concert to center the body 102 relative to the fasteners 108. The fasteners 108 may fasten to known locations on the receiver, providing a reproducible connection between the body 102 and the receiver.

The body 102 may have a plurality of grooves 110 on a surface thereof. In some embodiments, the body 102 may have other mechanical interlocking features, such as a square grid of recesses (e.g., a waffle pattern), a hexagonal grid of recesses (e.g., a honeycomb pattern), other repeating relief pattern, or combinations thereof. The plurality of grooves 110 may extend over a width and/or a length of the body 102. For example, at least one of the grooves 110 may extend over a full width of the body 102. In another example, at least one of the grooves 110 may extend over a distance less than the full width of the body 102. In some embodiments, the plurality of grooves 110 may be repeated over a full length of the body 102. In other embodiments, the plurality of grooves 110 may repeat over a distance less than a full length of the body 102.

The palette system 100 may further include one or more locking blocks 112 that may be affixed to the surface of the body 102. The locking blocks 112 may have a mechanical interlock with the plurality of grooves 110 in the surface of the body 102, allowing the locking blocks 112 to resist movement perpendicular to the plurality of grooves 110. For example, the locking blocks 112 may have a plurality of grooves thereon that complimentarily mate with the plurality of grooves 110 in the surface of the body 102. In other embodiments having other types of mechanical interlocking features in the body 102 (e.g., a waffle pattern, a honeycomb pattern, etc.), the locking blocks 112 may have features that complimentarily mate with the mechanical interlocking features. The locking blocks 112 may provide selectively securable anchor points against which a soft jaw 114 may apply a force to hold a workpiece (not shown) on the palette system 100.

In another embodiment, the one or more of the locking blocks 112 may be non-adjustable locking blocks consisting of vertical extensions of the palette body 102 at or near the ends thereof. In this embodiment, a floating spacer (not shown) may be used between the rear non-adjustable locking block and the wedge block 116 if needed. In other embodiments, a plurality of interchangeable floating blocks 118 could be provided having various dimensions to adjust the spacing between the wedge block and the non-adjustable locking blocks. In such an embodiment, the palette body 102 may have less or no mechanical interlocking features as the non-adjustable locking blocks are fixed in position relative to the palette body 102.

The soft jaw 114 may have a plurality of components. The soft jaw 114 may have a wedge block 116 and a floating block 118. The floating block 118 is configured such that it may move freely upon a surface of the body 102, regardless of whether the surface of the body 102 has grooves 110. The wedge block 116 and the floating block 118 may have complimentary angled faces that abut one another at an angled interface 115. The angled interface 115 may amplify a force applied to the wedge block 116 such that the force applied by the floating block 118 to a workpiece is greater than the force applied to the wedge block 116. The angled interface 115 may form an angle with the surface of the body 102 that is within a range having upper and lower values including any of 30°, 40°, 50°, 60°, 70°, 80°, or any value therebetween. For example, the angle with the surface of the body 102 may be within a range of 30° to 80°. In another example, the angle may be within a range of 40° to 70°. In yet another example, the angle may be about 60°. The wedge block 116 may be connected to the body 102 through an adjustable fastener 117 that extends through the wedge block 116 and at least partially into the body 102 of the palette system 100. The adjustable fastener 117 may be configured to be adjustable relative to the body 102. For example, the adjustable fastener 117 may be a threaded rod with threads that urge the adjustable fastener 117 vertically relative to the body 102. The adjustable fastener 117 may, therefore, apply a force in the vertical direction to the wedge block 116.

The wedge block 116 may move vertically relative to the floating block 118. The interaction of the wedge block 116 and the floating block 118 at the angled interface 115 may convert the vertical force applied to the wedge block 116 by the adjustable fastener 117 to a lateral force on the floating block 118. For example, as the wedge block 116 moves vertically downward (i.e., toward the body 102) the wedge block 116 may contact an adjacent locking block 112 and the floating block 118. The locking block 112 may be substantially fixed relative to the body 102, and the wedge block 116 may apply a force to the floating block 118 at the angled interface 115 that urges the floating block 118 laterally across the surface of the body 102 and away from the wedge block 116. The lateral motion of the floating block 118 may cause the floating block 118 to contact a workpiece and apply a force thereto.

The locking blocks 112 and/or the wedge block 116 may have adjustable fasteners 117 extending therethrough that extend into the body 102. In some embodiments, the adjustable fasteners 117 may extend into a slot 120 in the body 102 and threads on the adjustable fasteners 117 may mate with one or more complimentarily threaded backing members. The backing members are described in more detail in relation to FIG. 3 and FIG. 5.

Figure 2:
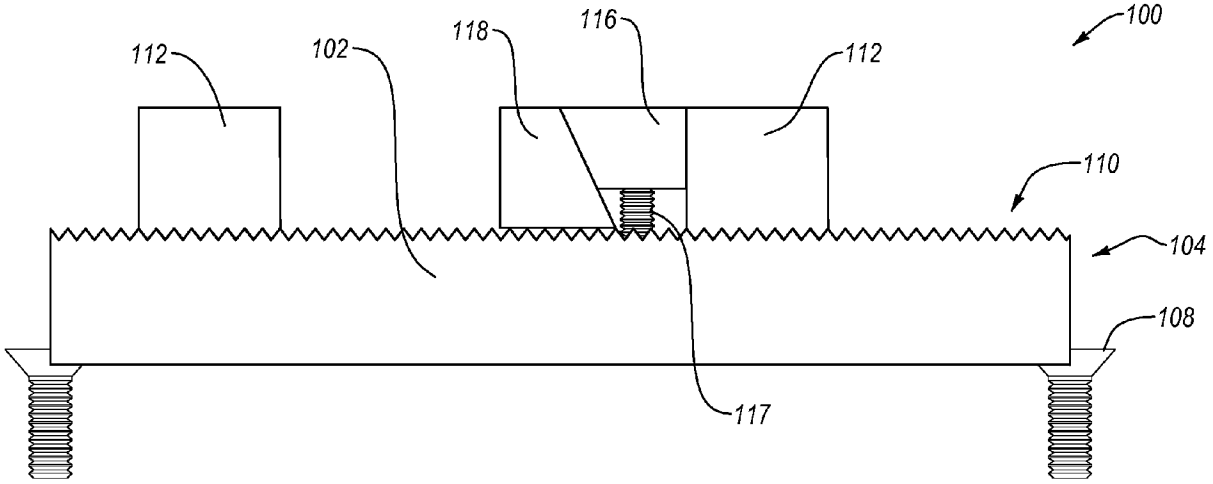
FIG. 2 is a side view of the embodiment of a high throughput palette system of FIG. 1.

FIG. 2 is a side view of the palette system 100. The palette system 100 may be affixed to a receiver by the fasteners 108 interacting with the beveled portions 106 of pockets 104 of the body 102. The body 102, as described, may have a plurality of grooves 110 (or other mechanical interlocking feature) in a surface thereof, which may interact with one or more complimentary grooves (or other mechanical interlocking feature) in the locking blocks 112. As shown in FIG. 2, the locking blocks 112 may each have one or more complimentary grooves that interact with the plurality of grooves 110 in the body 102. The locking blocks 112 may be secured against the body 102 by one or more adjustable fasteners 117 that extend at least partially into the body 102. The mechanical interlock between the plurality of grooves 110 and the complimentary features in the locking blocks 112 may allow the locking blocks 112 to withstand greater lateral forces than would a simple frictional force between the locking blocks 112 and the body 102 without mechanical interlocking features. As described herein, the mechanical interlock between the plurality of grooves 110 and the complimentary features in the locking blocks 112 may allow the locking blocks 112 to be positioned at known intervals.

FIG. 2 also illustrates that the wedge block 116 and the floating block 118 may have substantially flat lower surfaces. The wedge block 116 and the floating block 118 may, therefor, slide laterally across the plurality of grooves 110 without substantial interference from the plurality of grooves 110. The floating block 118 may be configured to move freely across the surface of the body 102. The locking block 112 may be moved when an adjustable fastener is loosened and the locking block 112 is able to be lifted above the plurality of grooves 110 of the body 102.

The wedge block 116 may have a height that is less than a height of the floating block 118. The wedge block 116 may have a greater vertical range of motion, allowing for greater lateral range of motion for the floating block 118 when the wedge block 116 has a height that is less than a height of the floating block 118. In other embodiments, the wedge block 116 may have a height that is the same as or greater than the floating block 118 and the adjustable fastener 117 may have a proportionately increased length to extend through the wedge block 118 and into the body 102.

Figure 3:
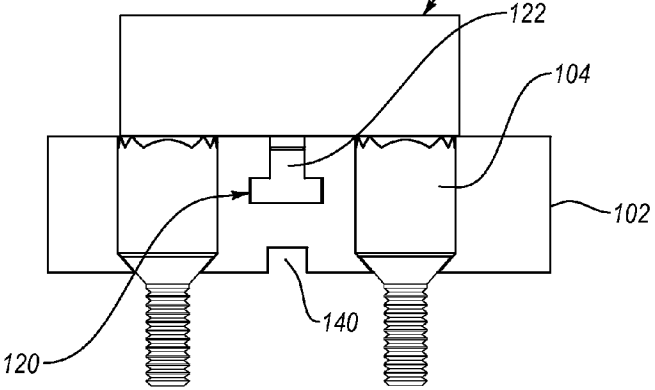
FIG. 3 is an end view of the embodiment of a high throughput palette system of FIG. 1.

FIG. 3 depicts the palette system 100 in an end view (90° from the view in FIG. 2). The palette system 100 may have a slot 120 that has an inverted T-shape. In other embodiments, the slot 120 may have angled sidewalls. In yet other embodiments, the slot 120 may have any cross-sectional shape that tapers from an interior of the body 102 toward a surface of the body 102. The slot 120 may allow for a complimentarily shaped backing member 122 to be inserted into the slot 120 at an end of the slot 120 and moved through the slot 120 to a desired position. The slot 120 may terminate between pockets 104, as shown in FIG. 3, or may terminate in a pocket 104, as shown in FIG. 1.

The backing member 122 may include a threaded bore through a portion of the backing member 122 into which an adjustable fastener may be threaded. The adjustable fastener and backing member 122 may thereby apply a compressive force between the adjustable fastener and the backing member 122 to compress a locking block 112 against the body 102. An adjustable fastener and a backing member 122 may at least partially determine the vertical position of a wedge block 116 relative to the slot 120 and body 102.

Figure 4:
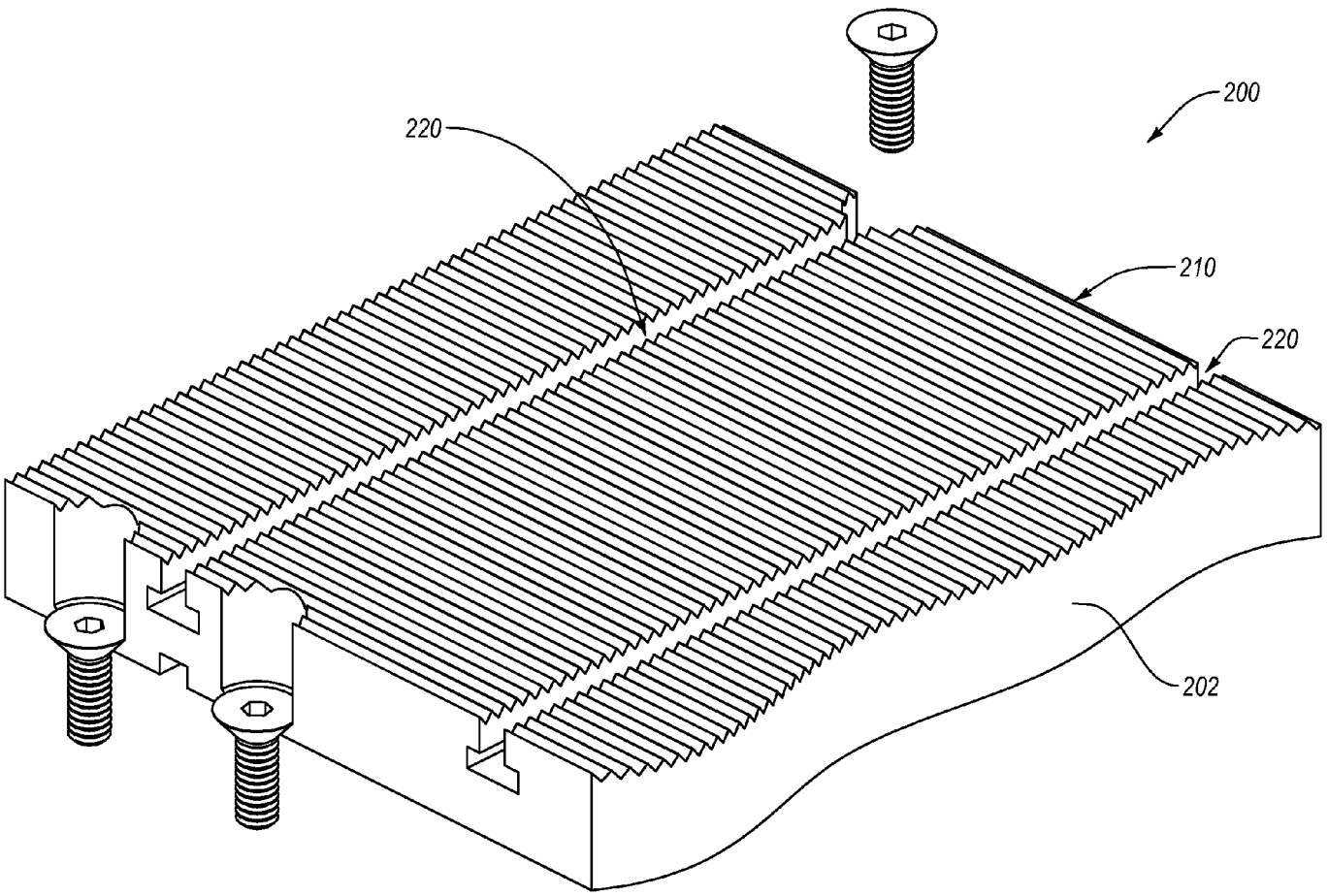
FIG. 4 is a perspective view of an embodiment of a palette body having a plurality of slots, according to the present disclosure.

FIG. 4 depicts another embodiment of a palette 200 having a body 202 that includes a plurality of slots 220. The body 202 may have a substantially continuous plurality of grooves 210 or other mechanical interlocking features. The plurality of grooves 210 may extend the full distance between slots 220. In other embodiments, the plurality of grooves 210 may extend less than the full distance between slots 220. The plurality of grooves 210 may allow a single locking block (similar or the same as locking blocks 112 described in relation to FIG. 1 through FIG. 3) to span the distance between a plurality of slots 220. A plurality of adjustable fasteners may be used to secure the locking block in more than one slot 220 at a time.

Figure 5:
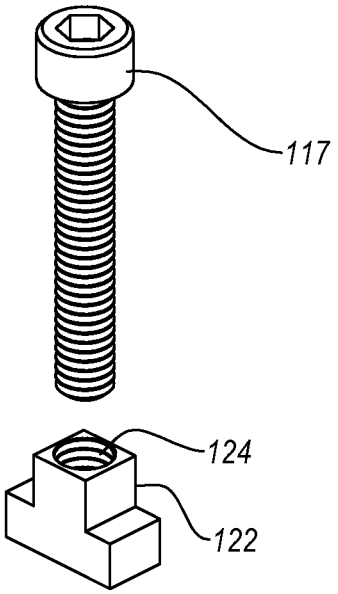
FIG. 5 is a perspective view of an embodiment of a backing member according to the present disclosure.

FIG. 5 depicts a backing member 122. The backing member 122 may be generally shaped as an inverted T to fit complimentarily in a slot, such as the slot 120 described in relation to FIG. 1 through FIG. 3. In other embodiments, the backing member 122 may be generally tapered toward an upper portion of the backing member 122. The backing member 122 may have a threaded bore 124 therein. The threaded bore 124 may complimentarily mate with the threads on the adjustable fastener 117.

The backing member 122 may apply a compressive force to the surfaces of a slot when the adjustable fastener 117 is rotated to urge the adjustable fastener 117 into the threaded bore 124 of the backing member 122. The backing member 122 may slide within the slot substantially without interference when the adjustable fastener 117 is rotated to urge the adjustable fastener 117 away from the backing member 122.

Figure 6:
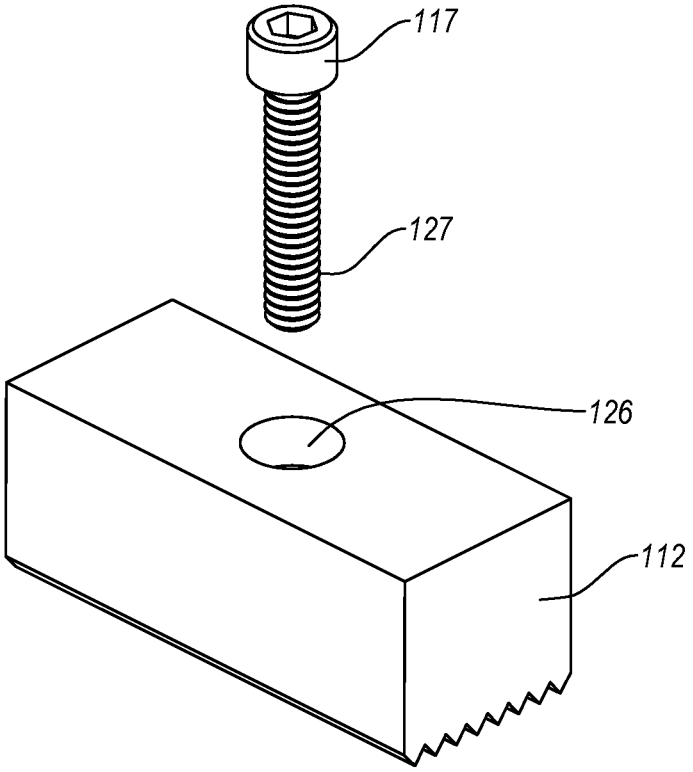
FIG. 6 is a perspective view of an embodiment of a locking block according to the present disclosure.

FIG. 6 depicts a locking block 112, similar to or the same as that described in relation to FIG. 1 through FIG. 3. The locking block 112 may have an unthreaded bore 126 extending therethrough. An adjustable fastener 117 may be positioned through the unthreaded bore 126. In some embodiments, the adjustable fastener 117 may have a length configured to allow at least part of a threaded portion 127 to protrude from the unthreaded bore 126. The threaded portion 127 may then engage with a backing member, such as that described in relation to FIG. 5. When the backing member is located in a complimentarily shaped slot in the body of a palette, the adjustable fastener 117 may engage with the backing member and, thereby, apply a compressive force to the locking block 112 in the direction of the body of the palette.

Figure 7:
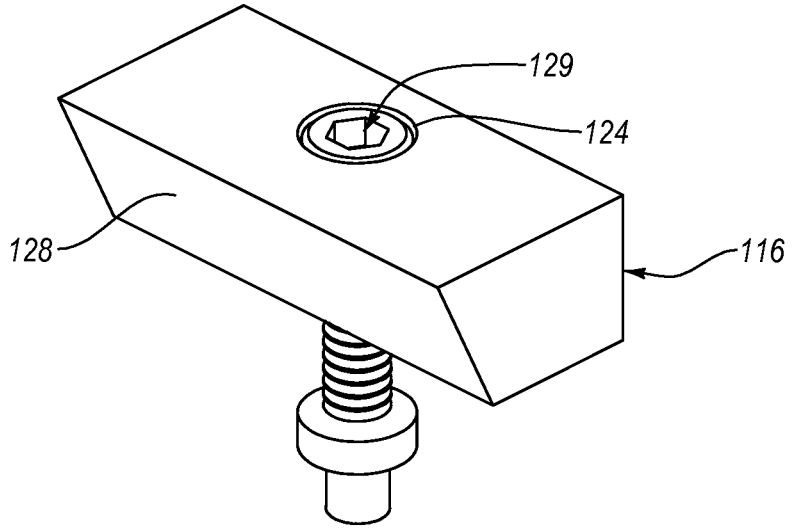
FIG. 7 is a perspective view of an embodiment of a wedge block according to the present disclosure.
Figure 8:
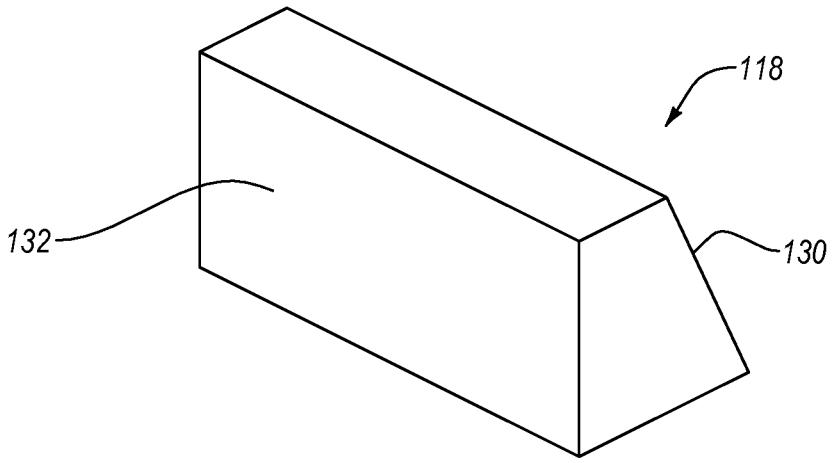
FIG. 8 is a perspective view of an embodiment of a floating block according to the present disclosure.

FIG. 7 and FIG. 8 depict parts of the soft jaw 114 described in relation to FIG. 1. FIG. 7 is a perspective view of the wedge block 116. The wedge block 116 may have a wedge face 128 oriented at an angle to the top and bottom of the wedge block 116. The wedge block 116 may have a substantially vertical unthreaded bore 124 extending therethrough. As described herein, the wedge block 116 may have a height that is less than that of the floating block 118 to allow an increase vertical range of motion of the wedge block 116. The wedge face 128 may, for example, move a greater distance relative to the floating block 118 resulting in an increased lateral range of motion of the floating block 118.

In some embodiments, the wedge block 116 may include a threaded bore 124 and a threaded rod 129 positioned therein. The threaded rod 129 may extend through the wedge block 116 and into a slot in the body of the palette. The threaded rod 129 may have a portion of the rod that engages with a wall of the slot. The threaded rod may be configured to rotate relative to the wedge block 116 and urge the wedge block vertically while the threaded rod 129 maintains a constant vertical position relative to the slot. In some embodiments, the threaded rod 129 may have left-hand threads thereon, such that a clockwise rotation of the threaded rod 129 from a user's perspective results in a lowering of the wedge block 116 and, hence, a "tightening" of the jaw.

The floating block 118 may have a slide face 130 and a contact face 132. The slide face 130 may be angled such that the slide face 130 mates with the wedge face 128 of the wedge block 116. The slide face 130 may receive a force from the wedge block 116 and the floating block 118 may move laterally in response to the force. The lateral movement of the floating block 118 may cause the floating block 118 to contact a workpiece with the contact face 132 and apply a force thereto.

Figure 9:
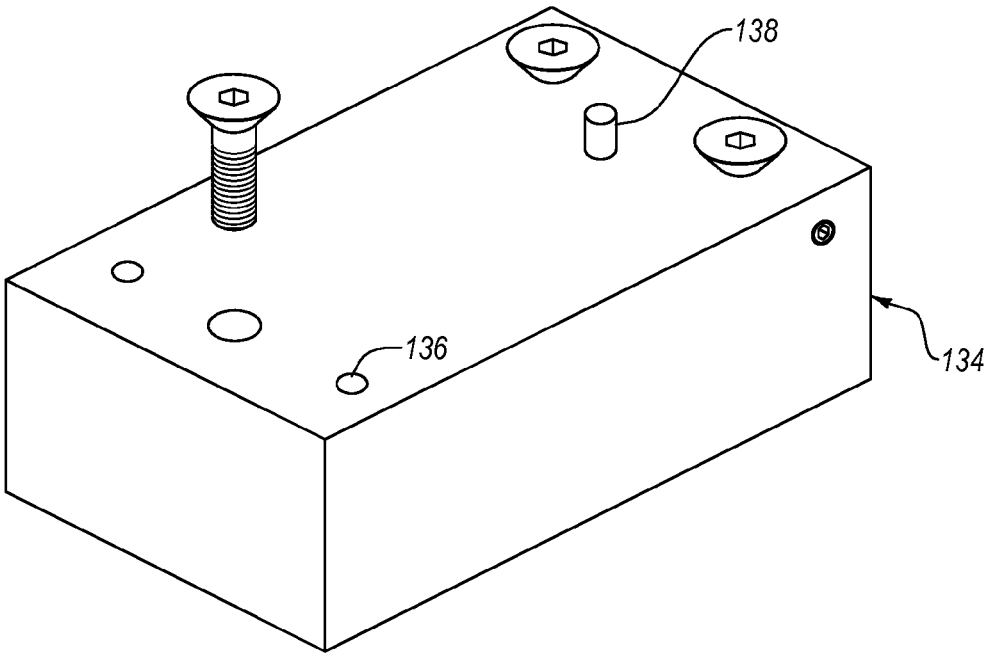
FIG. 9 is a perspective view of an embodiment of a receiver according to the present disclosure.

FIG. 9 is perspective view of an embodiment of a receiver 134. The receiver 134 may have one or more threaded bores 136 into which the fasteners 108 may be threaded. In some embodiments, the fasteners 108 may be locking screws that remain in the receiver 134 when the palette body 102 is removed and/or replaced. Allowing the fasteners 108 to be permanently or semi-permanently positioned on the receiver 134 may allow for the palette body 102 to be positioned on the receiver 134 with less positional variance of the palette body with respect to the CNC cutting machine. In some embodiments, the receiver 134 may include one or more mechanisms for retaining the fasteners 108 in place in the threaded bores 136. For example, a lock screw may be inserted at an angle to the fastener 108 to engage a portion of the fastener 108 located in the threaded bore 136 and limit or substantially prevent movement of the fastener 108 relative to the threaded bore 136.

In some embodiments, the receiver 134 and the palette body 102 may engage with one another via an engagement interface that allows for a coarse mechanical alignment of the receiver 134 and palette body 102 to quickly and easily position the palette body 102 on the receiver 134. For example, the receiver 134 may include one or more posts 138 that stand above a surface of the receiver 134. The one or more posts 138 may interact with one or more recesses 140 in the palette body 102. In some embodiments, the one or more recesses 140 in the palette body 102 may be perpendicular to a side of the palette body 102. In other embodiments, the one or more recesses 140 in the palette body 102 may be oriented at a non-perpendicular angle to a side of the palette body 102. In some embodiments, the one or more recessed 140 may have flared or curved ends to allow easier mating of the post 138 and the recess 140. For example, at least one end of a recess 140 may have a y-shaped flare to align a post 138 and direct the post 138 into the recess 140. In another embodiment, the post 138 may be located on the palette body 102 and the one or more recesses 140 may be located on the receiver 134.

The one or more posts 138 may provide one or more points of reference against which the palette body 102 may be oriented relative to the receiver 134. For example, because the location of the one or more threaded bores 136 and the one or more posts 138 may be known and constant for the receiver 134, a palette system, such as the palette system 100 described in relation to FIG. 1, may be precisely and reproducibly positioned on the receiver 134. In at least one embodiment, the post 138 may interact with recess 140 to position the palette body 102 on an axis about which the palette body 102 may rotate. The fasteners 108 may then be positioned in the one or more threaded bores 136 and tightened. The fasteners 108 in the threaded bores 136 may work with the one or more posts 138 and one or more recesses 140 to orient the palette body about the axis.

Figure 10:
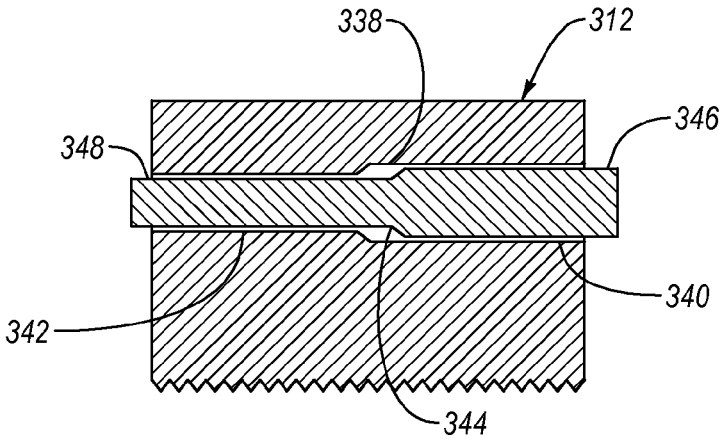
FIG. 10 is a side cross-sectional view of a locking block having a positioning pin therethrough according to the present disclosure.

Workpieces may be precisely and predictably positioned on a palette, which in turn may be precisely and predictably positioned on a receiver, according to the present disclosure. The workpieces may be transversely aligned in the soft jaw 114 by one or more positioning pins. FIG. 10 is a side cross-sectional view of another embodiment of a locking block 312 according to the present disclosure. The locking block 312 may have a channel 338 located through at least part of the locking block 312. The channel 338 may have a flared channel end 340 and a tapered end 342. The locking block 312 may have a positioning pin 344 located in the channel 338. The positioning pin 344 may have a flared pin end 346 and a tapered pin end 348 that are substantially complimentary to the flared channel end 340 and tapered channel end 342, respectively. For example, the tapered pin end 346 may have a greater diameter than the tapered channel end 342. The positioning pin 344 may, therefore, move toward the flared channel end 340 freely and may contact the channel 338 when the positioning pin 344 moves in the direction of the tapered channel end 342.

In some embodiments, the positioning pin 344 may have a length that is greater than the locking block 312, such that at least a portion of the flared pin end 346 and/or tapered pin end 348 extends from the locking block 312 at all times. In other embodiments, the positioning pin 344 may be configured such that the flared pin end 348 may be located entirely within the channel 338. In some embodiments, a locking block may have a plurality of channels and positioning pins to allow reproducible, discrete lateral positioning of a workpiece relative to the locking block.

Figure 11:
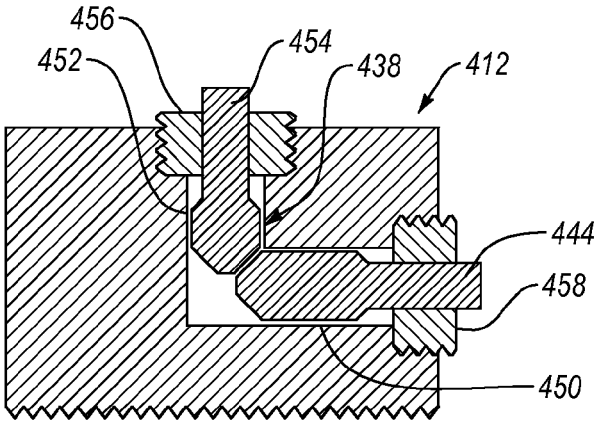
FIG. 11 is a side cross-sectional view of a locking block having a plurality of positioning pins oriented at an angle to one another according to the present disclosure.

FIG. 11 depicts another embodiment of a locking block 412 having a channel 438 and positioning pin 444. In some embodiments, the channel 438 may have a horizontal portion 450 (that is substantially perpendicular to a face of the locking block 412) and an angled portion 452 therein. The angled portion 452 may have a second pin 454. The positioning pin 444 and the second pin 454 may contact one another. The portion of the positioning pin 444 and the second pin 454 at which the positioning pin 444 and the second pin 454 meet may be angled, such that movement of the positioning pin 444 may move the second pin 454 and movement of the second pin 454 may move the positioning pin 444. Such an angled channel 438 may allow for use of a positioning pin in locations on a palette (such as palette system 100) having limited access or space.

The positioning pin 444 and second pin 454 may be limited in their movement by a position pin cap 458 and a second pin cap 456, respectively. The position pin cap 458 and the second pin cap 456 may be removably connected to the locking block 412. For example, the position pin cap 458 and the second pin cap 456 may have threads thereon and screw into complimentary threads in the locking block 412 at the outer ends of the horizontal portion 450 and angled portion 452, respectively. The position pin cap 458 may have an aperture therethrough that has a smaller diameter than at least a portion of the positioning pin 444. The position pin cap 458 may allow a portion of the position pin 444 to extend from the locking block 412 without allowing the position pin 444 to be entirely removed from the locking block 412. The second pin cap may have an aperture therethrough that has a smaller diameter than at least a portion of the second pin 454. The position pin cap 458 may allow a portion of the position pin 454 to extend from the locking block 412 without allowing the position pin 444 to be entirely removed from the locking block 412.

A palette according to the present disclosure may allow a user to position a workpiece in a known, precise, and reproducible location in an automated machining system. After an initial calibration, workpieces may then be positioned in and machined by the automated machining system with no recalibration of the system necessary. The palette may allow one or more workpieces to be machined on a single palette, and for the palette to be reloaded with more workpieces for machining without recalibration. The present palette may increase throughput and quality of workpieces machined in an automated machining system.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A palette system for an automated machining system, the palette system comprising:

a body having a top surface comprising a plurality of grooves and at least a first slot that is substantially perpendicular to the plurality of grooves;

two or more locking blocks, wherein each of the two or more locking blocks comprises a plurality of complementary grooves configured to interact with the plurality of grooves on the body to form a mechanical interlock between the two or more locking blocks and the top surface of the body;

a wedge block having an angled wedge face, the wedge block being connected to a wedge block backing member with an adjustable fastener such that adjusting the adjustable fastener moves the wedge block perpendicularly to the top surface of the body, the wedge block backing member being slidable within the first slot to independently move the wedge block between the two or more locking blocks; and a floating block selectively associated with the wedge block, the floating block having an angled slide face configured to engage the wedge face and the floating block comprising a substantially flat bottom surface, the substantially flat bottom surface configured to slide laterally across the plurality of grooves without substantial interference from the plurality of grooves, wherein the wedge block is configured to abut against a first of the two or more locking blocks and interact with the floating block to secure a workpiece between the two or more locking blocks.

2. The palette system of claim 1, wherein the body includes a plurality of pockets in substantially opposing sides of the body, each of the plurality of pockets being configured to provide a mounting interface to a known location on the automated machining system such that the body of the palette system is in a known position within the automated machining system when the palette is mounted to the automated machining system.

3. The palette system of claim 1, wherein the body includes a beveled portion on one or more ends thereof.

4. The palette system of claim 1, wherein the wedge block and floating block form an angled interface there between, the angled interface forming an angle with the top surface between 40° and 80°.

5. The palette system of claim 1, wherein the plurality of grooves are parallel grooves.

6. The palette system of claim 5, wherein the plurality of grooves extend over a full width of the body, and wherein the plurality of grooves have a repeating distance between each groove of the plurality of grooves.

7. The palette system of claim 1, wherein the slot extends into the body and has sidewalls that produce a generally T-shaped lateral cross-section of the slot.

8. The palette system of claim 1, wherein the slot extends into the body and has sidewalls that are angled to taper the slot toward the top surface.

* * * * *